US005145065A

United States Patent [19]

Mizutani et al.

[11] Patent Number: 5,145,065

[45] Date of Patent: Sep. 8, 1992

[54] PACKAGE FOR PHOTOGRAPHIC FILM CARTRIDGE

[75] Inventors: Shigemitsu Mizutani; Yoshihiro Seto; Hiroshi Tanaka; Yoshihiro Nishiyama, all of Kanagawa, Japan

[73] Assignee: Fuji Photo Film Co., Ltd., Kanagawa, Japan

[21] Appl. No.: 660,900

[22] Filed: Feb. 26, 1991

[30] Foreign Application Priority Data

| | | | |
|---|---|---|---|
| Feb. 26, 1990 | [JP] | Japan | 2-45235 |
| May 22, 1990 | [JP] | Japan | 2-131737 |
| May 22, 1990 | [JP] | Japan | 2-131738 |
| May 22, 1990 | [JP] | Japan | 2-131739 |
| Aug. 3, 1990 | [JP] | Japan | 2-206068 |
| Sep. 20, 1990 | [JP] | Japan | 2-251187 |
| Sep. 20, 1990 | [JP] | Japan | 2-251188 |

[51] Int. Cl.[5] ..... B65D 85/67; B65D 43/14

[52] U.S. Cl. ..... 206/389; 206/407; 229/125.35

[58] Field of Search ..... 206/407, 389; 229/125.33, 125.34, 125.35

[56] References Cited

U.S. PATENT DOCUMENTS

| | | | |
|---|---|---|---|
| 2,334,817 | 11/1943 | Gerahty . | |
| 3,933,297 | 1/1976 | Carlsson et al. | 229/125.35 |
| 3,988,185 | 10/1976 | Johnson et al. . | |
| 4,826,008 | 5/1989 | Cloosterman | 206/407 |

FOREIGN PATENT DOCUMENTS

| | | |
|---|---|---|
| 3330188 | 3/1984 | Fed. Rep. of Germany . |
| 58-46413 | 10/1983 | Japan . |
| 61-250639 | 11/1986 | Japan . |
| 2-48372 | 2/1990 | Japan . |
| 120464 | 12/1965 | Netherlands . |
| 1275051 | 5/1969 | United Kingdom . |

*Primary Examiner*—William I. Price

*Attorney, Agent, or Firm*—Burns, Doane, Swecker & Mathis

[57] ABSTRACT

A package for a photographic film cartridge which comprises a paper tube treated with a moistureproofing treatment. The paper tube contains a photographic film cartridge and has moistureproof caps fitted to both end openings of the paper tube. The inside surface of the moistureproof caps is joined to the inside or outside surface of the paper tube by thermal adhesion. In this package, since the package is composed of a naturally decomposable paper tube as the main material, the package can be made compact and lightweight, and waste treatment is easy.

1 Claim, 21 Drawing Sheets

PACKAGE FOR PHOTOGRAPHIC FILM CARTRIDGE

BACKGROUND OF THE INVENTION

This invention relates to a package for a photographic film cartridge such as a 16 or 35 mm photographic film cartridge. More particularly, this invention relates to a package in which a photographic film cartridge is hermetically packed.

A 35 mm photographic film cartridge is used particularly for a single lens reflex camera, a twin lens reflex camera and a half frame camera which are now widely used.

The photographic film cartridge is constructed of a spool, a cartridge body and a photographic film rolled around the spool as minimum essential elements. The photographic film exists in the cartridge body in a state that most parts of the unexposed film is initially rolled around the spool, and it is extended out of the cartridge to be supplied to exposure for forming an image. Then, the film is rewound in the cartridge body.

In the past, for example, a polypropylene resin container disclosed in Japanese Patent KOKAI No. 61-250639 and a metal sheet container disclosed in Japanese Utility Model KOKOKU No. 58-46413 were generally used as the photographic film cartridge. That is, a photographic film cartridge was put in a cylindrical resin container body or a cylindrical metal container body, and was hermetically packed by fitting a cap into the container body.

The above-mentioned packages for a photographic film cartridge have various problems. In the case of the container made of a resin, since the calorific value produced by burning is large, the incinerator used is greatly affected in its endurance by burning of many containers. While, even if the containers are buried in the ground, they do not decompose because they are stable to heat, water, light, bacteria and chemicals.

In the case of the metal container, the container can not be burned and there are more problems in view of the treatment of industrial wastes. Moreover, the recovery of the conventional containers is low, and there are similar problems as general waste such as domestic waste.

Incidentally, since photographic films are susceptible to ambient environment conditions such as humidity, it is necessary to shield photographic photosensitive materials from gases such as water vapor, sulfurous acid gas and formalin gas in order to maintain the initial qualities for a long time.

SUMMARY OF THE INVENTION

An object of the invention is to provide a package for a photographic film cartridge capable of decomposing naturally or burning easily with securing the above basic functions.

Another object of the invention is to provide a small and light package for a photographic film cartridge having a suitability for waste treatment.

The above objects have been achieved by the following packages.

A package for a photographic film cartridge which comprises containing a photographic film cartridge in a paper tube treated with a moistureproof treatment, fitting moistureproof caps to both end openings of the paper tube, joining the inside surface of the moistureproof caps to the outside surface of the paper tube by thermal adhesion.

A package for a photographic film cartridge which comprises containing a photographic film cartridge in a paper tube treated with a moistureproof treatment, fitting moistureproof caps to both end openings of the paper tube, joining the inside surface of the moistureproof caps to the inside surface of the paper tube by thermal adhesion.

A package for a photographic film cartridge which comprises containing a photographic film cartridge in a paper tube treated with a moistureproof treatment, fitting moistureproof caps to both end openings of the paper tube, and joining the inside surface of one moistureproof cap to the outside surface of one end of the paper tube and joining the inside surface of the other cap to the inside surface of the other end of the paper tube by thermal adhesion.

A package for a photographic film cartridge which comprises containing a photographic film cartridge in a paper tube treated with a moistureproof treatment and fitting a moistureproof cap at both end openings of the paper tube, said paper tube is composed of a paper material provided with a thermoplastic resin layer having a barrier property on at least one of the surfaces, said paper material being wound and Joined by thermal adhesion.

A package for a photographic film cartridge which comprises providing a bottom to a paper tube by adhering a moistureproof circular bottom plate to an end folded inside of the paper tube, containing a photographic film cartridge and fitting a moistureproof cap to the opening of the paper tube.

A package for a photographic film cartridge which comprises providing a bottom to a paper tube by adhering the outside surface of the peripheral end folded at a right angle of a circular bottom plate having a longer diameter than the inside diameter of the paper tube to the inside surface of the bottom end opening of the paper tube which is folded inside and engaged with the peripheral end of the circular bottom plate.

A package for a photographic film cartridge which comprises containing the photographic film cartridge in a flat bottom rectangular tube container composed of a sealing body made by folding a paper material treated with a moistureproof treatment in series and forming a gable shape top to seal the photographic film cartridge in the package.

DETAILED DESCRIPTION OF THE INVENTION

Figure 1:
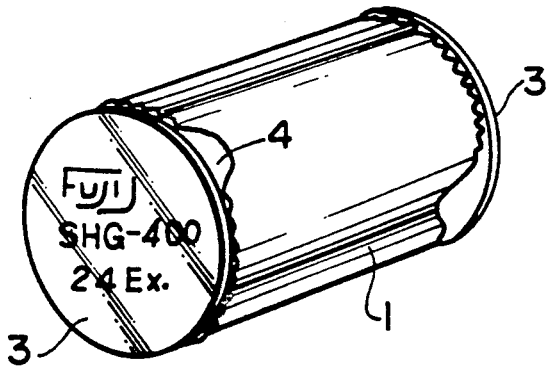
FIG. 1 is a perspective view of a package for a photographic film cartridge embodying the invention.
Figure 2:
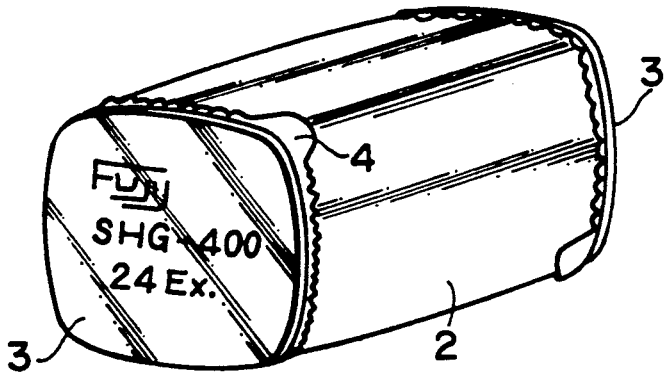
FIG. 2 is a perspective view of another package for a photographic film cartridge embodying the invention.
Figure 3:
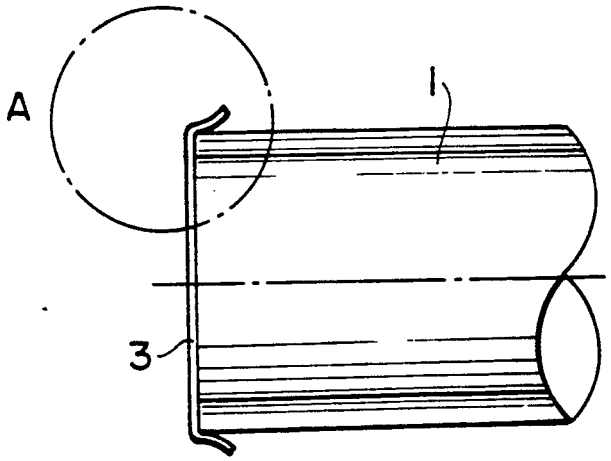
FIG. 3 is a partial section thereof.

In FIGS. 1 to 3, a photographic film cartridge (not illustrated) is put in a paper tube 1 or 2 treated with moistureproofing, and moistureproof caps 3,3 are fitted to both end openings of the paper tube 1. Then, the outside of the outer peripheral ends of the paper tube 1 are adhered to the inside of the caps 3,3 by heat sealing to complete the package for a photographic film cartridge of the invention.

The paper tube includes a cylindrical paper tube 1 as shown in FIG. 1 and a polygonal paper tube 2 as shown in FIG. 2. The inside dimension of both tubes is about 0.5 to 3.0 mm larger than the outside dimension of the photographic film cartridge placed therein. The material of the paper tube 1 or 2 is preferably neutral paper, and a waste paper having a pH of from 6 to 9 can be used. The thickness of the paper tube is preferably more than 0.7 mm in view of strength.

The moistureproof treatment of the paper tube 1 and 2 is selected among the following methods. That is, a plastic thin film is laminated onto the outside and/or inside of the paper tube. An aluminum foil is adhered onto the outside, and a plastic thin film is laminated to the aluminum foil. A neutral paper composing the paper tube is impregnated with a moistureproof agent. The outside of the paper tube is covered by shrink packaging using a heat shrinkable material. The plastic thin film material for the moistureproof treatment is a polyethylene resin, a vinyl resin or the like having high moistureproofness, and the film thickness is preferably 7 to 20 μm in view of thermal adhesion to the inside of a moistureproof cap. When the aluminum foil is used in addition to the plastic membrane, the moistureproof effect increases.

The material of the moistureproof cap 3,3 is selected from laminates composed of an aluminum foil and a plastic thin film, laminates of an aluminum foil, a plastic thin film laminated to one side thereof and a paper or a plastic thin film laminated to the other side thereof, and laminates of a plastic film and a paper or plastic thin film.

The moistureproof cap 3,3 is a peelable type. The thickness is 15 to 30 μm, and the thickness of the plastic thin film part applied to the inner surface is 7 to 15 μm in view of thermal adhesion. The moistureproof cap may be provided with a tab 4 so that the package is easily opened.

Figure 4:
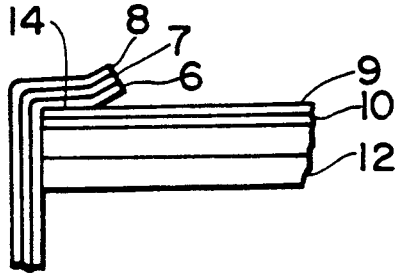
FIG. 4 is an enlarged partial section at part A of FIG. 3.

The paper tube shown in FIG. 4 is composed of a neutral paper 12, a laminating paper 10 laminated to the neutral paper 12 and a plastic thin film 9 laminated to the laminating paper 10.

Figure 5:
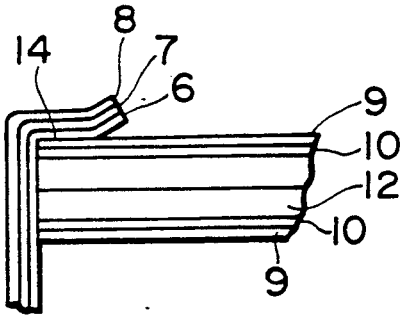
FIGS. 5 to 9 are enlarged partial sections indicating various joining structures employed in the package of the invention.

The paper tube shown in FIG. 5 is composed of a neutral paper 12, laminating papers 10 laminated to both side of the neutral paper 12 and plastic thin films 9 laminated to both laminating papers 10.

Figure 6:
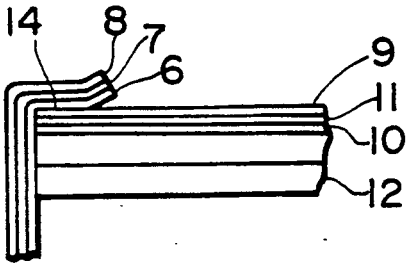

The paper tube shown in FIG. 6 is composed of a neutral paper 12, a laminating paper 10 laminated to the neutral paper 12, an aluminum foil 11 laminated to the laminating paper 10 and a plastic thin film 9 laminated to the aluminum foil 11.

Figure 7:
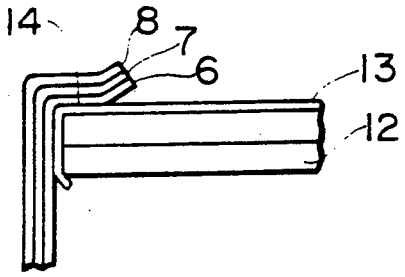
Figure 8:
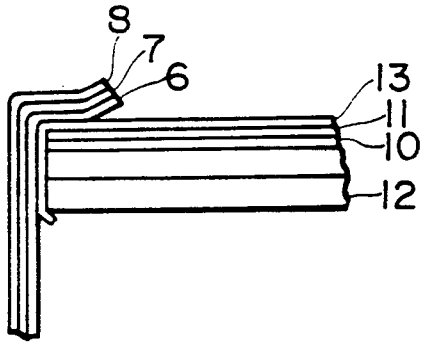
Figure 9:
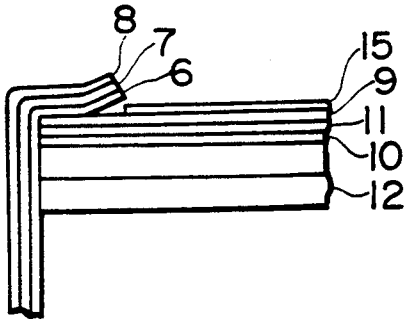

The paper tubes shown in FIGS. 7 to 9 are composed of the paper tubes shown in FIGS. 4, 5 and 6 and a heat shrinkable material 13 or 15 covering each paper tube by shrink packaging.

In every figure of FIGS. 4 to 9, the moistureproof cap used is composed of an aluminum foil 7, a plastic thin film 6 laminated to one side of the aluminum foil 7 and a paper 8 adhered to the other side of the aluminum foil 7, and the plastic thin film 6 composing the inside surface of the moistureproof cap is joined to the plastic thin film 9 or the heat shrinkable material 13 composing the outside surface of the paper tube through a heat sealing layer 14 by heating. The heat seal can easily be conducted by a commercial heat sealer, a suitable width of the heat seal is in a range of 1 to 3 mm. The heat seal of both ends of the paper tube may be conducted simultaneously or successively, and in the case of successive sealing, a photographic film cartridge may be put into the paper tube before or after the heat sealing of the first end.

The inside of the paper tube is preferably dried to a water content of not more than 0.3% prior to inserting the photographic film cartridge into the paper tube. By the drying, the moisture liberated from the photographic film is absorbed by the paper tube after accomplishing the package of the invention, and therefore, the photographic film is kept in a low humidity state to prevent a gradual variation.

The moistureproof cap 3 is made by punching the above-mentioned materials for a moistureproof cap. A tab 4 may be provided at the periphery of the cap in order to make opening of the package easy.

Moreover, the package of the invention may be supplied as a commercial good without placing into an outer box by covering with a shrinkable film and by printing for dressing to improve the appearance.

Figure 10A:
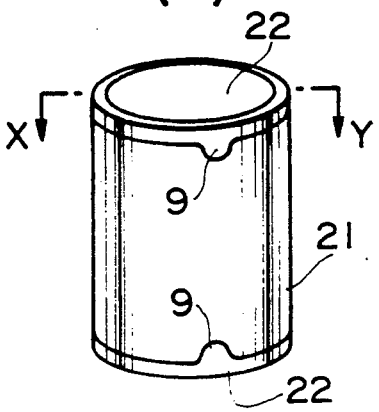
FIG. 10*a* is a perspective view of another package for a photographic film cartridge embodying the invention.
Figure 10B:
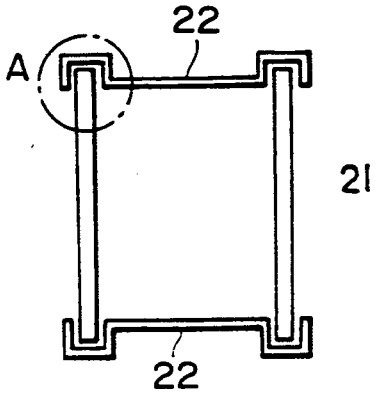
FIG. 10*b* is a section thereof.
Figure 10C:
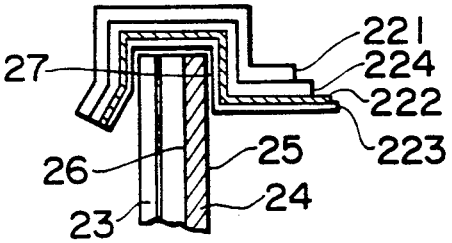
FIG. 10*c* is an enlarged partial section at part A of FIG. 10*b*.
Figure 11A:
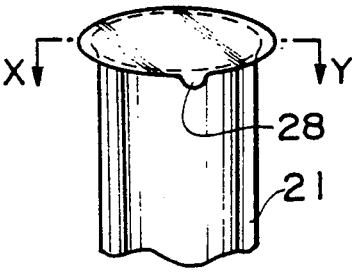
FIG. 11*a* is a partially perspective view of another package for a photographic film cartridge embodying the invention.
Figure 11B:
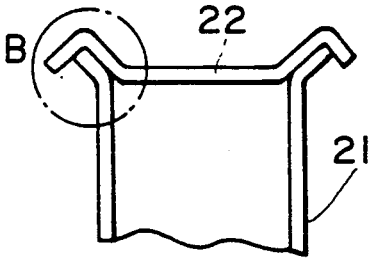
FIG. 11*b* is a section thereof.
Figure 11C:
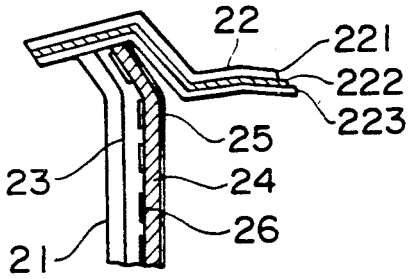
FIG. 11*c* is an enlarged partial section at part B of FIG. 11*b*.

In FIGS. 10 and 11, a photographic film cartridge (not illustrated) is put in a paper tube 21 treated with moistureproofing, and moistureproof caps 22 are fitted to both end openings of the paper tube 21. Then, the outside of the outer peripheral ends of the paper tube 21 are adhered to the inside of the caps 22 by heat sealing to complete the package for a photographic film cartridge of the invention.

Figure 13:
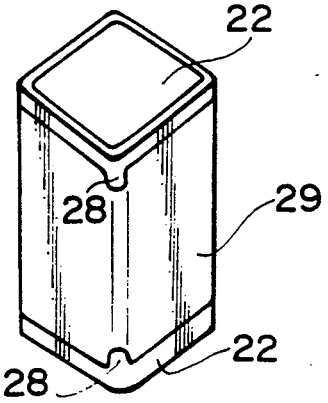
FIG. 13 is a perspective view of another package embodying the invention.

The paper tube includes a cylindrical paper tube 21 as shown in FIG. 10 and a polygonal paper tube 29 as shown in FIG. 13. The inside dimension of both tubes is about 0.5 to 3.0 mm layer than the outside dimension of the photographic film cartridge.

The paper tubes 21 and 23 may be produced by winding spiral of a paper material multiple times slit in a tape or by winding the paper material in a circumferential direction. Suitable paper materials are selected by considering the rigidity and formability, and tube boards, linerboards and the like are suitable. The winding number is assigned due to a required rigidity and the thickness of the selected material, and the thickness is preferably not less than 0.7 mm.

The moistureproofing of the paper tube 21 or 23 is conducted by laminating an aluminum foil, a plastic film on which aluminum is deposited, a plastic film excellent in gas barrier or a laminate thereof on the inside of the paper tube. If necessary, a X ray-shielding material such as a lead foil can be effectively laminated. The aluminum foil is preferably about 7 to 20 μm in thickness, and the aluminum metallized film is preferably a film of nylon, PET or the like less than 50 μ in thickness on which an aluminum membrane of not less than 200 Å is deposited.

The plastic film excellent in barrier property is selected out of olefin resins film excellent in moistureproofness such as polyethylene films and polypropylene films, nylon films and ethylene vinyl alcohol copolymer films excellent in gas-shieldability, polyvinyl chloride films and polyvinylidene chloride films having both properties, and combinations thereof by coextrusion, lamination, coating or the like.

The moistureproof cap 22 is preferably made of a laminate containing an aluminum foil in view of keeping a fitting state, and usually being composed of a paper or a plastic film / an aluminum foil / a hot-melt adhesive or an adhesive resin layer, or a combination of the above laminate.

A section of FIG. 10(*a*) is shown in FIG. 10(*b*) and an enlarged view of part A indicated in FIG. 10(*b*) is shown in FIG. 10(*c*). The paper tube 21 is composed of a paper 23 that is 0.5 mm in thickness and wound twice, a barrier material 24 being a polyethylene terephthalate film 25 μm in thickness having an aluminum membrane 400 Å in thickness laminated on the inside of the paper 23 through an adhesive layer 26 being a LDPE resin 15 μm in thickness and a heat sealing layer 25 being a LDPE resin film 20 μm in thickness laminated on the aluminum metallized PET film. The cap 22 is a multilayer material composed of a supporting sheet 221 being an art paper of 81.4 g/m$^2$, an adhesive layer 224 being a LDPE resin film of 13 μm, a barrier layer 222 being an aluminum foil of 20 μm and a heat sealing layer 223 being a LDPE resin film of 20 μm. The inside wall of the package is sealed by fitting the cap 22 into each end of the paper tube 21 so as to surround the edge portion on three sides by the circumferential edge of the cap 22, and then by joining the inside wall of the paper tube to the heat sealing layer 24 of the cap by heat sealing.

Another package is shown in FIG. 11 wherein at least one end of the paper tube is enlarged outward having the same layer-construction as the paper tube shown in FIG. 10. In the paper tube, when the inside of the paper tube is joined to the inside of the cap at the fitting part 27 by heat seal, the fitting part 27 can be sufficiently pressed by supporting the outside of the paper tube. Therefore, a stable sealed state can be obtained.

Figure 12A:
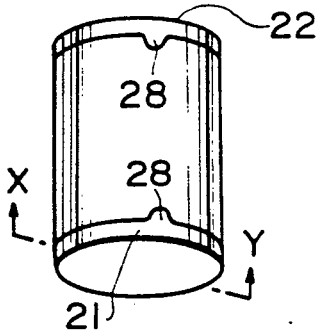
FIG. 12*a* is a perspective view of another package for a photographic film cartridge embodying the invention.
Figure 12B:
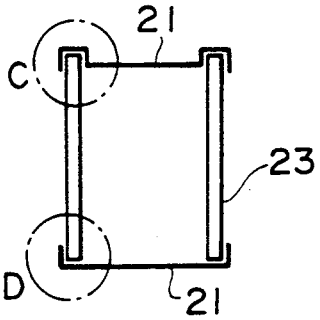
FIG. 12*b* is a section thereof.
Figure 12C:
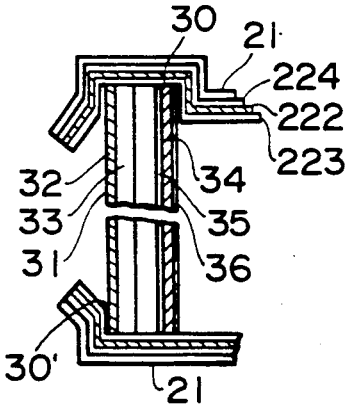
FIG. 12*c* is an enlarged partial section at parts C and D of FIG. 12*b*.

FIG. 12 shows an example of sealing the bottom of the paper tube on the outside. As shown in FIG. 12(*c*), a barrier layer 32 of 30 μm LDPE resin film is provided on the periphery, and the heat seal is conducted at the fitting part 30 of the upper part and the fitting part 30' of the lower part.

Figure 14:
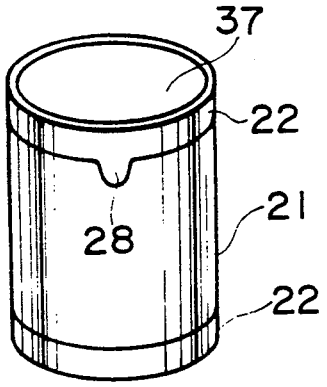
FIG. 14 is a perspective view of another package of the invention provided with a reinforcing member.

FIG. 14 shows an example of fitting a reinforcing member 37 to a moistureproof cap 22 for protecting it.

Figure 15:
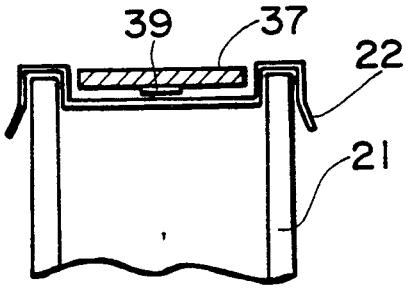
FIG. 15 is a partial section thereof.

FIG. 15 shows an example of fixing the reinforcing member to the moistureproof cap 22 by an adhesive 39. In order to join the inside of the moistureproof cap 22 to the inside of the paper tube 21 in a recessed state, the cap is preferably composed of a thin and flexible material because of securing the sealing stability. Even if a great compressive force or drop shock is added to the package, cap breakage or separation of the sealed part does not occur by the reinforcing member. For example, as shown in FIG. 14, the reinforcing member having a size coinciding with the recession of the cap is fitted into the recession. A fibreboard of 500 g/m$^2$ is used as the reinforcing member. The reinforcing member may be joined, if necessary, by an adhesive 39 as shown in FIG. 15. The heat seal is easily conducted by a commercial heat sealer having a seal head modified into a shape adapted to the invention. The width of the heat seal is suitably 1 to 3 mm. The heat seal between the caps and both ends of the paper tube may be conducted simultaneously or successively, and in the case of successive sealing, a photographic film cartridge may be put in the paper tube before or after the heat sealing of the first end. The moistureproof cap may be provided with a tab 28 so that the package is easily opened.

Figure 16A:
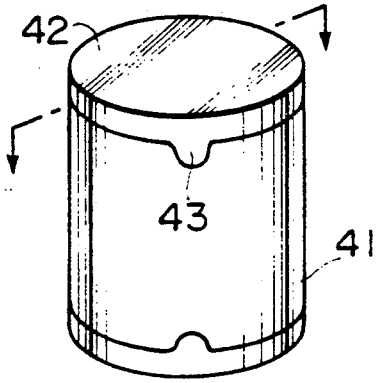
FIG. 16*a* is a perspective view of another package of the invention.
Figure 17A:
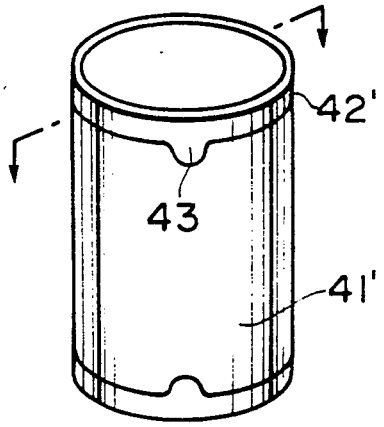
FIG. 17*a* is a perspective view of another package of the invention.
Figure 16B:
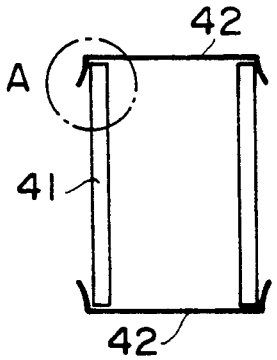
FIG. 16*b* is a section thereof.
Figure 17B:
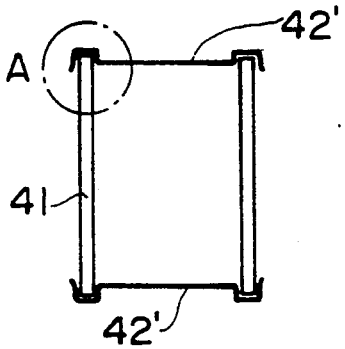
FIG. 17*b* is a section thereof.
Figure 16C:
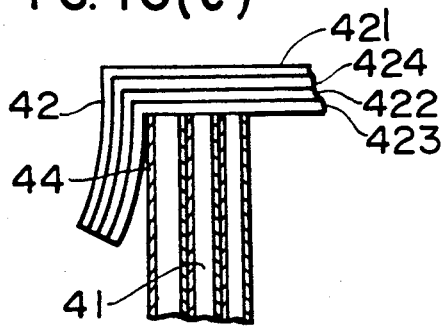
FIG. 16*c* is an enlarged partial section at part A of FIG. 16*b*.
Figure 17C:
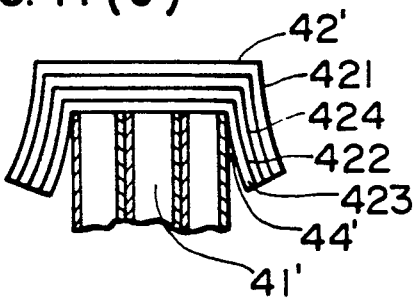
FIG. 17*c* is an enlarged partial section at part A of FIG. 17*b*.

In FIGS. 16 and 17, a photographic film cartridge (not illustrated) is put in a paper tube 41 treated with moistureproofing, and moistureproof caps 42 are fitted to both end openings of the paper tube 41. Then, the outside of the outer peripheral ends of the paper tube 41 are adhered to the inside of the caps 42 by heat seal to complete the package for a photographic film cartridge of the invention.

Figure 18:
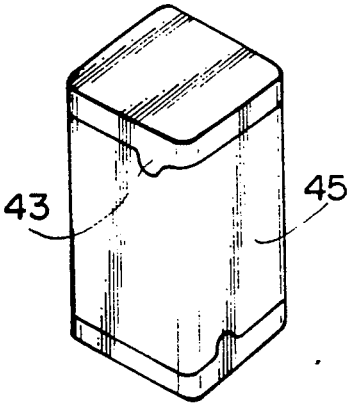
FIG. 18 is a perspective view of another package of the invention.

The paper tube includes a cylindrical paper tube 41 as shown in FIG. 16 and a polygonal paper tube 45 as shown in FIG. 18. The inside dimension of both tubes is about 0.5 to 3.0 mm larger than the outside dimension of the photographic film cartridge.

The paper tubes 41 and 45 may be produced by winding a spiral of a paper material multiple times slit in a tape or by winding the paper material in a circumferential direction. Suitable paper materials are selected by considering the rigidity and formability, and tube boards, linerboards and the like are suitable. The winding number is assigned due to a required rigidity and the thickness of the selected material, and the thickness is preferably not less than 0.7 mm.

For the sake of making the paper tube 41 moistureproof, a thermoplastic resin layer having barrier property is applied on either or both sides of the paper material, and the paper material is wound in a spiral with heating the surface of the paper material at a temperature capable of welding.

The thermoplastic resin having barrier property includes polyethylene resins, polypropylene resins, polyolefin copolymer resins such as EVA resin, EEA resin and EMA resin, polyester resins, polyamide resins and acrylic resins. The polyolefin resins are the most preferred in view of processability and barrier property. When the thermoplastic resin is applied to both surfaces of the paper material, the resin applied to one surface may be the same as or different from the other surface. Moreover, in view of the balance between barrier property and adhesive capability, a blend or coextrusion of plural resins may be used. The thickness of the layer is 15 to 100 μm, preferably 20 to 50 μm, for securing heat fusion. A tackifier such as wax, rosin or terpene may be added to the resin for improving the heat fusion. The layer may be formed by applying the thermoplastic resin to the surface of the paper material directly by an extruder or by joining a film of the thermoplastic resin formed previously to the surface of the paper material through an adhesive layer. Heating techniques include direct blowing of hot air, infrared heating, using the flame of a gas burner and the like.

The moistureproof cap 42 is preferably composed of a laminate having an aluminum foil to secure the fitting to the paper tube, and is usually composed of a paper or a plastic film / an aluminum foil / a hot melt adhesive or an adhesive resin layer, or a combination of the above laminate.

Figure 19:
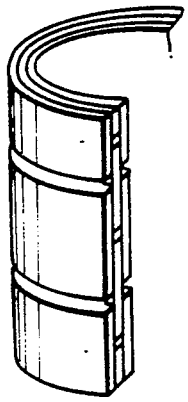
FIGS. 19 to 21 are partial cutaway perspective views of paper tubes applied to the package of the invention.
Figure 20:
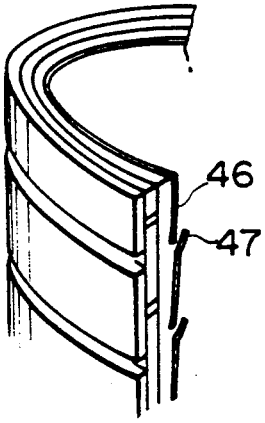
Figure 21:
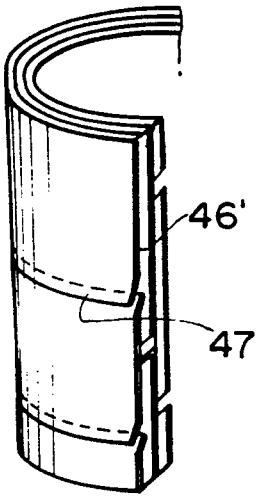
Figure 22:
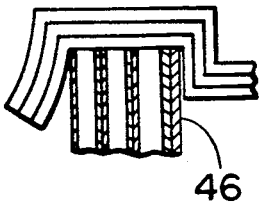
FIGS. 22 to 25 are enlarged partial sections indicating joining structures of the package of the invention.
Figure 23:
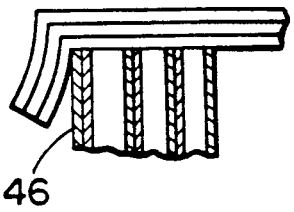

When a paper tube is formed by winding the paper material in a spiral, the sectional surface of the paper material is exposed as shown in FIG. 19. Therefore, the barrier property is lower than the amount of each barrier material. When particularly severe barrier property is required, the barrier property needs to be increased. Since the barrier property of WP paper for photographic film and of a milk carton is not so great, to compensate barrier property is occasionally necessary. As a way for improving the barrier property, a thin barrier layer 46,46' separately provided on the whole inside or outside of the paper tube by winding it so that a side overlaps with the other side, as shown in FIGS. 20 and 21. The barrier property is improved by joining the barrier layer to the inside of the cap by heat seal as shown in FIGS. 22 and 23. The thin barrier layer is composed of an aluminum foil, a plastic film metallized with aluminum, a plastic film excellent in barrier property or a laminate thereof. A suitable aluminum foil is usually 7 to 20 μm in thickness, and a suitable aluminum metallized film is a film such as a nylon film or PET film of less than 50 μm which is metallized with an aluminum membrane of 200 Å. The plastic film excellent in barrier property includes polyolefin resin films such as polyethylene films and polypropylene films excellent in moistureproofness and nylon films and ethylene-vinyl alcohol copolymer films excellent in gas barrier property, polyvinyl chloride films and polyvinylidene chloride films excellent in both properties and the like. The barrier layer is formed of one of the above plastic films or a combination of them formed by coextrusion, lamination or coating.

In the example shown in FIG. 16, the outside of the paper tube is joined to the cap by heat sealing. FIG. 16 (a) is a perspective view of the example, (b) is a sectional view thereof and (c) is an enlarged view of part A of (b). The paper tube 41 is composed of a paper of 0.35 mm in thickness and LDPE resin films of 20 μm in thickness laminated to both surfaces of the paper by extrusion lamination, and is rolled three times with heating. The cap 42 is composed of a support 421 being an art paper of 81.4 g/m$^2$, an adhesive layer 424 being a LDPE layer of 13 μm, a barrier layer 422 being an Al foil of 20 μm and a heat seal layer 423 being a LDPE film of 20 μm, and is joined to the inside of the paper tube 41 at the fitting part 44 of the heat seal layer by heat sealing, so that the package becomes air-tight.

In an example shown in FIG. 17, the inside of a paper tube is joined to a cap by heat sealing.

In FIGS. 20 and 21, a barrier layer 46 is separately provided on the inside or outside of a paper tube with an overlapping margin 47. The barrier layer is composed of a biaxially stretched polypropylene film of 20 μm in thickness coated with a polyvinylidene chloride resin. The other construction is the same as the example shown in FIG. 16. FIGS. 22 and 23 are partial sectional views of the paper tube to which a cap is fitted.

Figure 24:
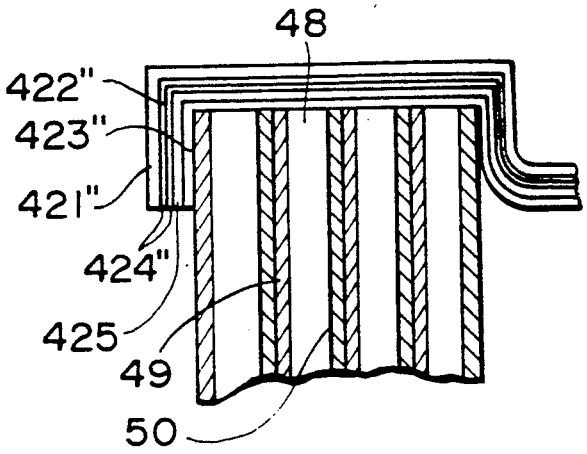

In an example shown in FIG. 24, a paper tube is formed using WP paper for photographic paper, and composed of a paper 48 of 135 g/m$^2$, a LDPE layer 49 of 20 μm, a HDPE layer 50 of 25 μm, a support 421'' of the cap being an art paper of 81.4 g/m$^2$, an adhesive layers 424'' being a LDPE film of 15 μm, an Al layer 422'' being an Al foil layer of 15 μm, a reinforcing layer 425 being a PET film of 12 μm and a heat seal layer 423'' being an EVA film of 50 μm. The paper tube has an inside diameter of 30 mm ϕ and a length of 50 mm, and the width of the sealing part is 1 mm. The water vapor permeability of the package measured by JIS Z 0222 was 20 mg/24 hrs/40° C. 90%.

Figure 25:
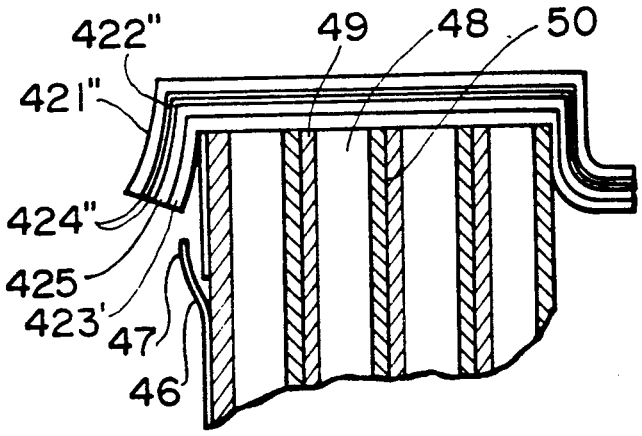
Figure 26A:
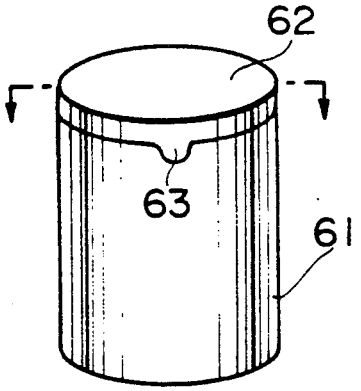
FIG. 26*a* is a perspective view of another package of the invention.
Figure 26B:
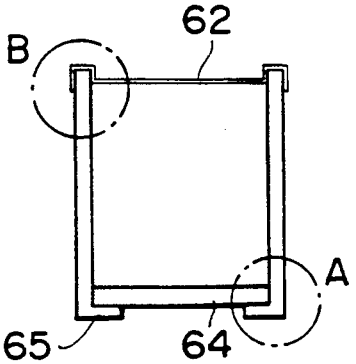
FIG. 26*b* is a section thereof.
Figure 26C:
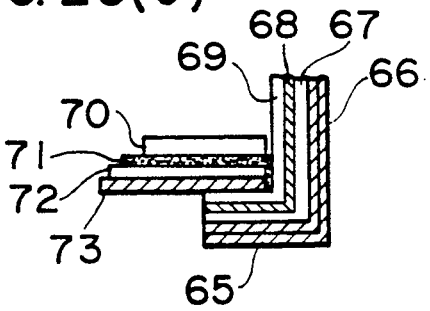
FIG. 26*c* is an enlarged partial section at part A of FIG. 26*b*.
Figure 26D:
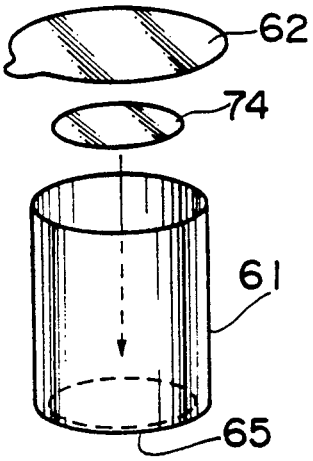
FIG. 26*d* is a perspective view indicating an assembling procedure of the package and FIG. 26*e* is an enlarged partial section at part B of FIG. 26*b*.
Figure 26E:
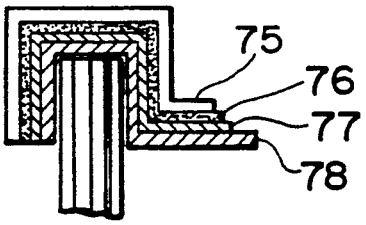
Figure 27A:
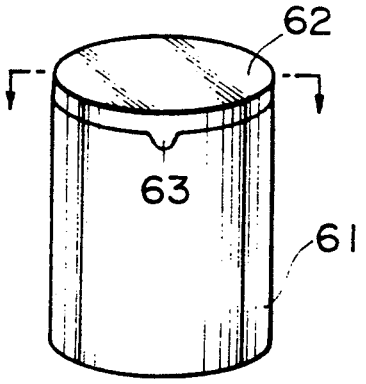
FIG. 27*a* is a perspective view of another package of the invention.
Figure 27B:
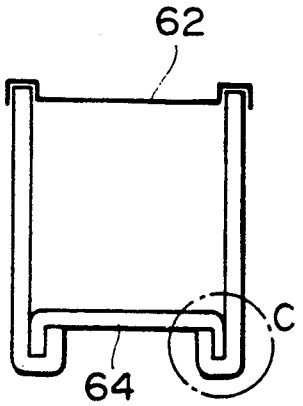
FIG. 27*b* is a section thereof.
Figure 27C:
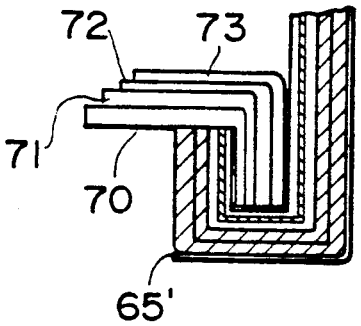
FIG. 27*c* is an enlarged partial section at part C of FIG. 27*b*.
Figure 27D:
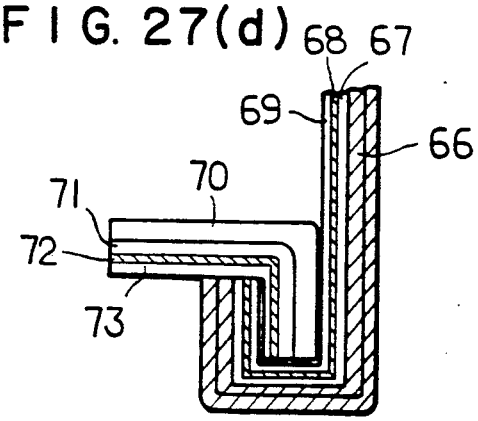
*FIGS. 27d* and 27*e* are enlarged partial sections of other packages of the invention.
Figure 27E:
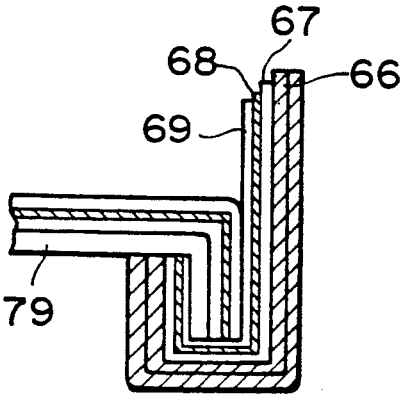

In the examples shown in FIGS. 24 and 25, the barrier layer 46 is composed of a PVDC-coated biaxially stretched polypropylene film 20 μm in thickness having a water vapor permeability of 2.5 g/m$^2$/24 hrs (trade name "SENESI KOP", made by DAISERU) and the width of the overlapping margin 47 is 4 mm. The water vapor permeability of the package measured by JIS Z 0222 was 10 mg/24 hrs/40° C. 90%.

The heat seal is easily conducted by a commercial heat sealer having a seal head modified according to the shape of the invention. The width of the seal is suitably 0.5 to 3 mm. The heat seal between the caps and both ends of the paper tube may be conducted simultaneously or successively, and in the case of successive sealing a photographic film cartridge may be put in the paper tube before or after the heat sealing of the first end. The moistureproof cap may be provided with a tab 43 so that the package is easily opened.

In an example shown in FIG. 26, a circular plate 74 made of a board treated with a moistureproof treatment is inserted in a paper tube 61 treated with a moistureproof treatment as shown in FIG. 26(*d*), and the end of the paper tube 61 is bent inside as shown in FIG. 26(*c*). The bent part is joined to the circular plate 74. After placing a photographic film cartridge (not illustrated) in the paper tube, the moistureproof cap 62 is fitted to the paper tube, and the inside of the paper tube is joined to the cap as shown in FIG. 26(*a*).

The paper tube is cylindrical as shown in FIGS. 26 and 27, each inside diameter is about 0.5 to 0.3 mm larger than the outside diameter of the photographic film cartridge placed therein.

The paper tube 61 may be produced by winding a spiral of a paper material multiple times slit in a tape or by winding the paper material in a circumferential direction. Suitable paper materials are selected by considering the rigidity and formability, and tube boards, linerboards and the like are suitable. The winding number is assigned due to a required rigidity and the thickness of the selected material, and the thickness is preferably not less than 0.7 mm.

The moistureproof treatment of the paper tube 61 is conducted by laminating an Al foil, a plastic film metallized with Al or a plastic film excellent in barrier property or a laminate thereof to the inside of the paper material. A suitable aluminum foil is usually 7 to 20 μm in thickness, and a suitable aluminum metallized film is a film such as a nylon film or PET film of less than 50 μm which is metallized with an aluminum membrane of 200 Å. The plastic film excellent in barrier property includes polyolefin resin films such as polyethylene films and polypropylene films excellent in moistureproofness and nylon films and ethylene-vinyl alcohol copolymer films excellent in gas barrier property, polyvinyl chloride films and polyvinylidene chloride films excellent in both properties and the like. The barrier layer is formed of one of the above plastic films or a combination of them formed by coextrusion, lamination or coating.

The circular plate 65 is preferably a board of more than 0.3 mm in thickness treated with the same moistureproof treatment as the paper tube.

The moistureproof cap 62 is preferably composed of a laminate containing an Al foil in order to secure the fit, usually composed of a paper or a plastic film / an Al foil /a hot melt adhesive or an adhesive layer, or a combination of the above laminate.

FIG. 26(*a*) is a perspective view of an example, FIG. 26(*b*) is a sectional view, FIG. 26(*c*) is a enlarged view of part A of FIG. 26(*b*).

In FIG. 26(*b*) and (*c*), the paper tube 61 is composed of a paper 66 of 0.5 mm in thickness and wound two times, and an Al foil 68 of 7 μm in thickness laminated to the inside surface of the paper 66 by an adhesive layer 67 of 13 μm LDPE film and a heat seal layer 69 of 20 μm LDPE film laminated to the Al foil 68. The circular plate 74 is composed of a board of 0.5 mm in thickness, an adhesive layer 71 the same as the adhesive layer 67, an Al foil 72 the same as the Al foil 68 and a heat seal layer 73 the same as the heat seal layer 69. The heat seal layer 69 of the bent part of the paper tube 61 is joined to the heat seal layer 73 of the circular plate 74 by heating, so that the bottom part is rendered air-tight.

The cap is composed of a support 75 of an art paper of 81.4 g/m$^2$, an adhesive layer 76 of 15 μm LDPE film, a heat seal layer 78 of 30 μm LDPE film and an Al foil 77 of 9 μm, and the heat seal layer 78 is joined to the heat seal layer 69 of the paper tube by heat sealing. Therefore, the package is air-tight.

Another example having a different shape of the bottom part is shown in FIG. 27. In FIG. 27(*c*), the side of a circular plate and the end of a paper tube are bent to face each other, and the heat seal layer 73 is joined to the paper tube. In FIG. 27(*d*), the heat seal layer is provided on the outside of the circular plate. In FIG. 27(*e*), a heat seal layer 79 is provided on each side of the circular plate, and both heat seal layers 79 are joined to the paper tube. The moistureproof cap may be provided with a tab 63 so that the package is easily opened.

Figure 28:
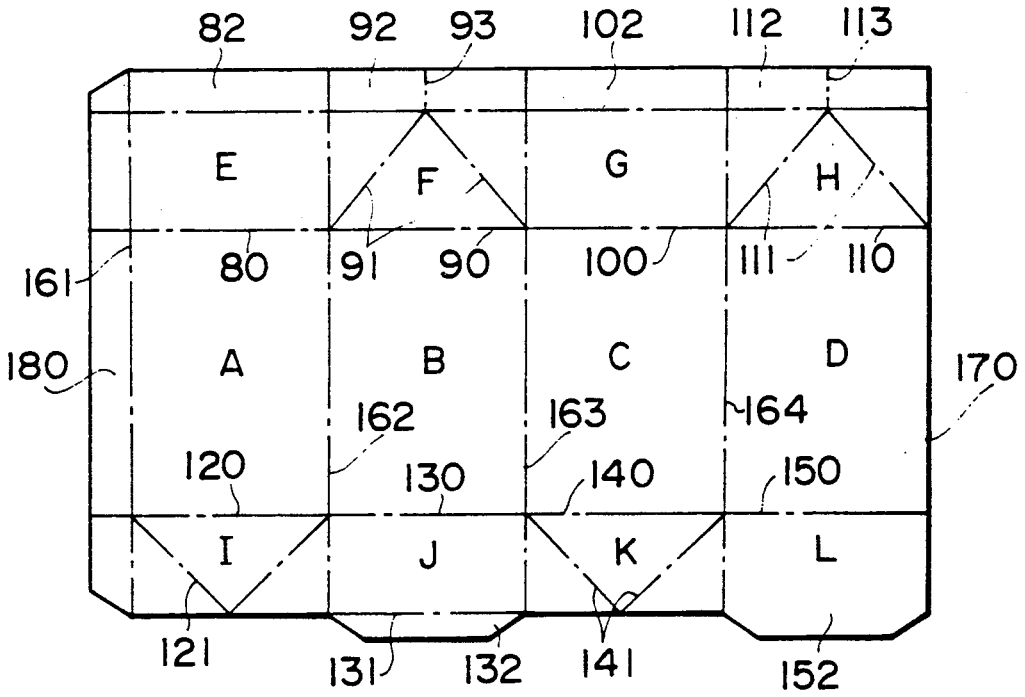
FIG. 28 is a development of a blank sheet used for the package of the invention.
Figure 29:
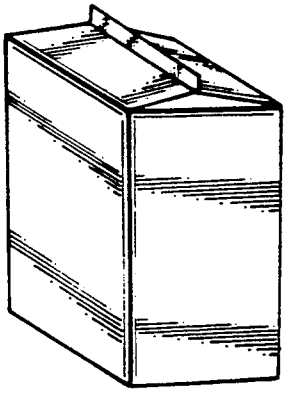
FIG. 29 is a perspective view indicating the constructed state of the blank sheet.

FIG. 28 is a development of a blank sheet of an example of the invention. The blank sheet is folded along creases, and the body and bottom are sealed by heating. After inserting a photographic film cartridge (not illustrated) in the body, the opening part is sealed by heat seal. Thus, the package for photographic film cartridge shown in FIG. 29 is completed.

A gavel top type used as a paper container for liquid such as milk or juice can be applied to the basic construction of the invention. The package of the invention does not need liquid tightness capable of resisting a level of liquid pressure which is required for liquid containers but needs a high barrier property capable of sufficiently shielding undesirable gases for photographs such as water vapor, sulfurous acid gas and formalin gas.

The process for assembling the package is described according to FIG. 28. First, the inside surface of the end portion 170 of the face D is joined to the outside surface of the face 180 by heat sealing to form a rectangular tube. The faces I and K are folded inside at a right angle at the creases 120 and 140 being folded at the creases 121 and 141, and at the same time, the faces J and L are folded inside at a right angle along the creases 130 and 150. Then, the tongue 132 folded back at 180° is joined to the tongue 152 by pressing from the outside and inside with heating. Thus, the box having a bottom is formed, and at this stage, a photographic film cartridge is inserted in the box. Then, the triangular parts of the faces F and H are folded inside in the same procedure as employed for forming the bottom. The extended parts 92, 112 of respective faces F and H are folded back at 180°, while, the inside surfaces of the extended parts 82, 102 of respective faces E and G face each other. In this state, folded inside surfaces of the extended parts 92, 112 are interposed between the inside surfaces 82, 102, and the folded top in a gable form is formed by pressing with heating sufficiently from the outside of the extended parts 82, 102 to complete a sealed package of the photographic film cartridge.

A filling and packaging machine for a carton of a gavel top type can be applied to the package, as it is.

Figure 37:
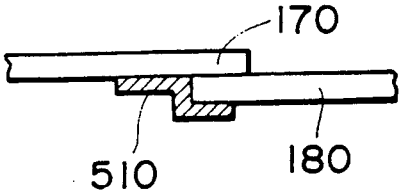
FIGS. 37 and 39 are partial sections indicating joining structures of blank sheets.
Figure 35:
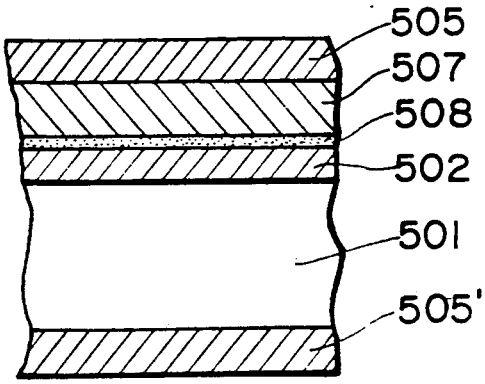
Figure 38:
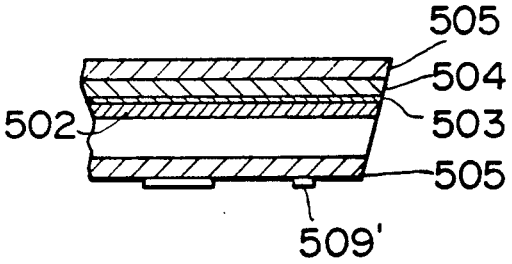

The process for joining the inside surface of the end 170 of the face D to the outside surface of the face 180 may, if necessary, precede the other processes. In this case, a moistureproof tape 510 is preferably joined to the end of the face 180, and shown in FIG. 37, in order to prevent water vapor permeation at the Joining part. A polyethylene film of about 50 μm is used as the moistureproof tape.

Figure 30A:
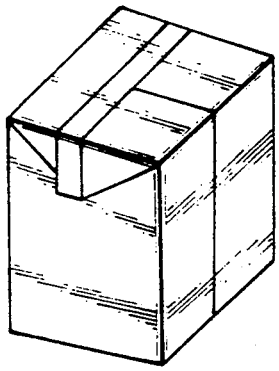
FIGS. 30 and 31 are perspective views of another blank sheet used for the package of the invention.
Figure 30B:
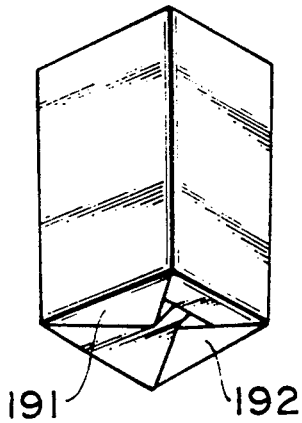
Figure 31:
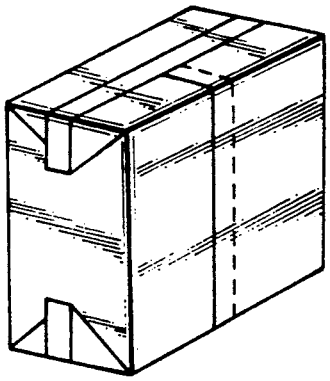

A package of the brick type as shown in FIGS. 30 and 31 can be also utilized as the package of the invention. In this type, a blank sheet is similar to the package of FIG. 29. While, since the outside end is contacted with the surface of the package, the bulk of the package can be reduced. As a result, efficiency of transportation and storage can be improved.

Figure 32:
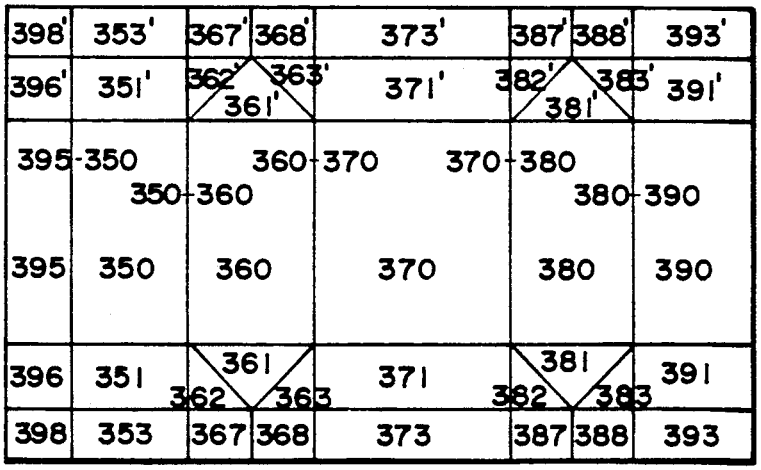
FIG. 32 is a development thereof.
Figure 33:
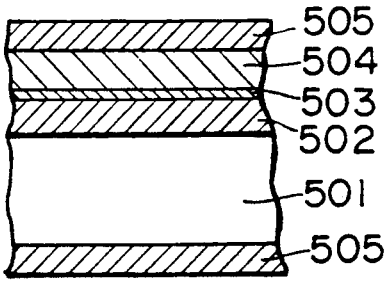
FIGS. 33 to 36 and 38 are partial sections of blank sheets applicable to the invention.
Figure 36:
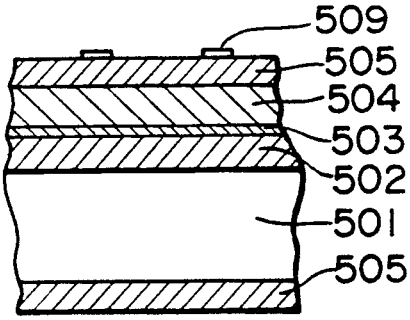
Figure 34:
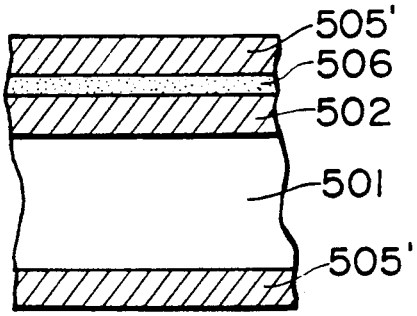

The package shown in FIG. 30 is described in detail. FIG. 32 is a development of the blank sheet of the package shown in FIG. 30.

The process for assembling the package is as follows.

(1) The face 395 is folded at the crease 395–350 so that the inside surface faces outside, and the face 395 is joined to the face 350.

(2) The folded inside surface of the face 395 is joined to the inside surface of the face 390 to form a tube.

(3) The tube is folded at a right angle at creases 350–360, 360–370, 370–380 and 380–390 to form a rectangular tube.

(4) The face 373 and the face 353 and 393, the face 367 and the face 368, the face 387 and the face 388 are respectively joined together to form the bottom.

(5) The fin-shape part of the bottom is folded so as to contact the surface of the bottom.

(6) As shown in FIG 30(*b*) the face 361 and 381 projecting in a triangular shape are folded contact the surface of the bottom and then Joined thereto.

(7) A photographic film cartridge is inserted.

(8) The face 373 and the faces 353, 393, the face 367 and the face 368, the face 387 and the face 388 are respectively joined together to form the top.

(9) The fin-shaped part of the top is folded so as to contact the surface of the top.

(10) As shown in FIG. 30(a) the face 361 and 381 projecting in a triangular shape are joined.

Thus, the package for a photographic film cartridge is completed.

Figure 39:
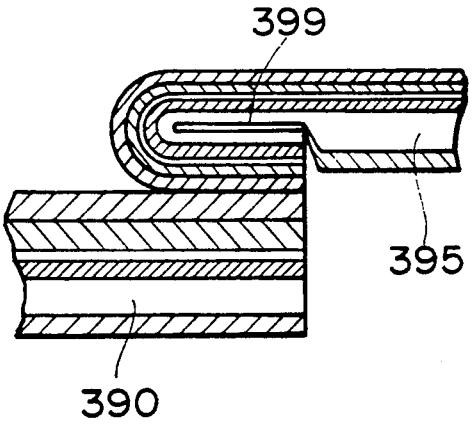

The above process (b) may be conducted in both side folding similar to the process (a) shown in FIG. 31. Moreover, the processes (1) and (2) may be separated and precede the other processes. In this case, a part or the entire of the paper material 399 of the face 395 may be scraped, and attached by an adhesive as shown in FIG. 39, in order to thin the joining part.

The inside diameter of the package is about 0.5 to 3.0 mm larger than the photographic film cartridge placed therein.

A suitable thickness of the paper material is 0.2 to 0.5 mm, and is not restricted to the above thickness provided that it withstands folding, because of providing a barrier layer on the inside. The layer construction of the container for liquid may be applied to the invention. However, to incorporate an Al foil, an Al metallized film or a PVDC-coated film excellent in moistureproofness and gas barrier property is preferred. Moreover, a lead foil or the like is preferably laminated in order to shield X-rays.

In the above process (2) of the brick type package for forming a blank sheet, since the inside surfaces are always joined together, an excellent barrier property can be obtained, because the sectional face is not exposed.

Representative examples of layer construction are shown in FIG. 33, 34, 35 and 36.

In the above FIGS. 501 is a card paper of 300 g/m$^2$, 502 is an adhesive layer 15 μm LDPE film, 503 is a 400 Å Al metallizing layer, 504 is 25 μm PET film, 505 is a 30 μm PE film for adhesion, 506 is a 9 μm Al foil, 507 is a 25 μm OPP film, 508 is a PVDC coating layer, 509 is a printing layer.

The package for a photographic film cartridge of the invention can contain a variety of photographic film cartridges, and examples shown in FIGS. 40 to 47 are suitable for the invention.

Figure 40:
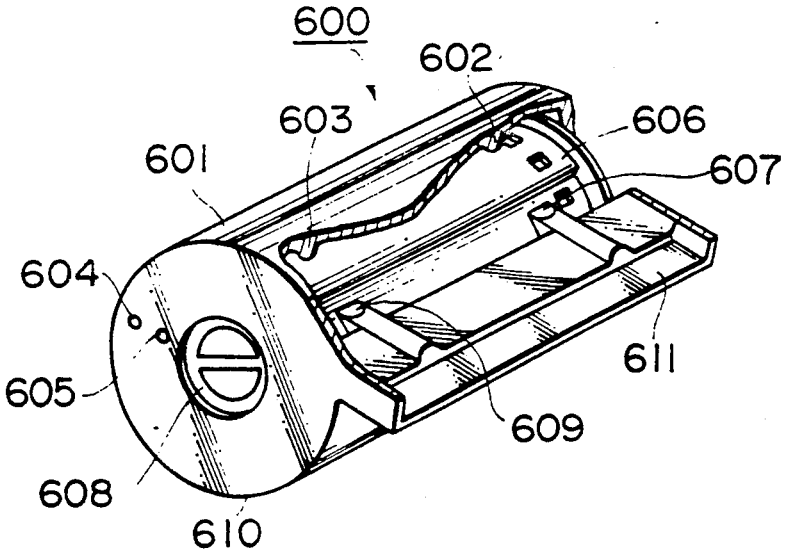
FIGS. 40 to 47 indicates some photographic film cartridges applicable to the invention.

In the photographic film cartridge shown in FIG. 40, a pair of ribs 602, 603 is formed in a circumferential direction on the inside surface of a cartridge body 601 to prevent the deconvolution of the photographic film 606 by being in contact with the film 606. Separation claws 609, 611 are formed on the ribs 602, 603 for separating the end of the film 606 from the outside surface of the film 606. A pair of terminals 604, 605 is formed on a cartridge cap 610.

In the photographic film cartridge 600 thus composed when the spool 608 is rotated clockwise, the end of the film 606 is accordingly rotated clockwise. The end of the film 606 is separated from the outside surface of the film 606 by the separation claws 609, 611 and extended from the cartridge body 601 through the slot.

Figure 41:
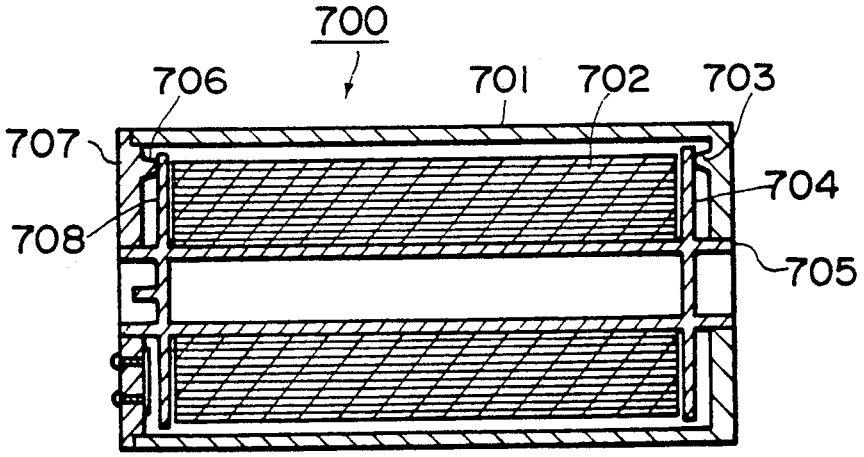

In the photographic film cartridge 700 shown in FIG. 41, a pair of protrusious 703, 706 are formed in an opposed position on a cartridge body 701 and a cartridge cap 707. These protrusions 703, 706 are in contact with the flanges 704, 708 of a spool 705, and bend the flanges 704, 708 inside. The film 702 is interposed between the bent flanges 704, 708, so that the end of the film 702 does not peel from the outside surface of the rolled film 702. Therefore, the deconvolution of the film 702 from the spool 705 does not occur, and initial film advance of the film 702 can be conducted by rotating the spool 705.

Figure 42:
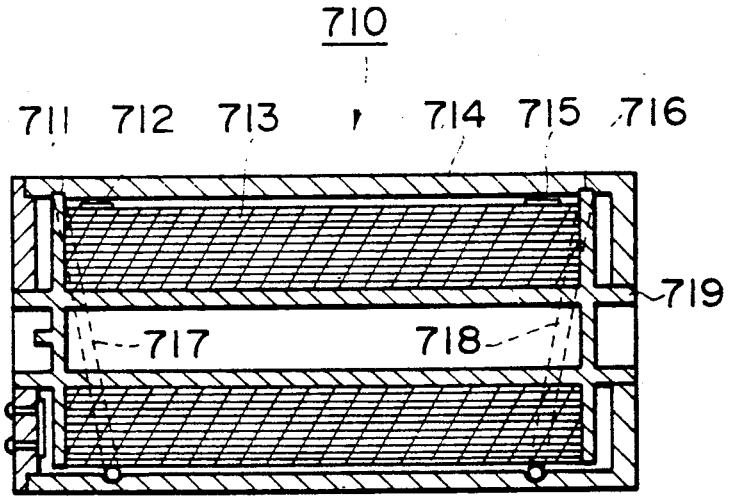

In the photographic film cartridge shown in FIG. 42, a pair of furrows 711, 716 are formed in a circumferential direction on the inside surface of a cartridge body 714. Rings 717, 718 are fitted in the furrows 711, 716 and are in contact with the outside surface of the film 713 to prevent the deconvolution of the film 713. When the spool 719 is rotated with rotating the leading end of the film 713 upward in this figure, the end of the film is released from the rings 717, 718. Thus, the end of the film 713 is separated from the outside surface of the film 713 by the separation claws 712, 715, and is delivered to the slot.

Figure 43:
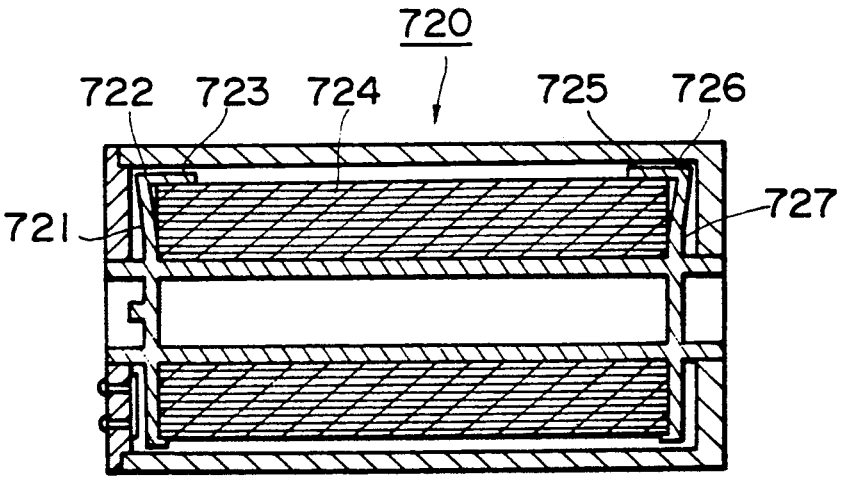

In the photographic film cartridge shown in FIG. 43, claws 722, 726 are formed toward the inside at the periphery of the flanges 721, 727. These claws 722, 726 are in contact with the outside surface of the film 724 to prevent deconvolution of the film 724. Moreover, the claws 722, 726 are in contact with the side surface of the separation claws 723, 725, so that the claws 722, 726 are bent outside as shown the figure. Accordingly, when the end of the film 724 is rotated, the end being in contact with the separation claws 723, 725 is released from the claws 722, 726 and separated from the outside surface of the film 724. Then, it is delivered to the slot.

Figure 44:
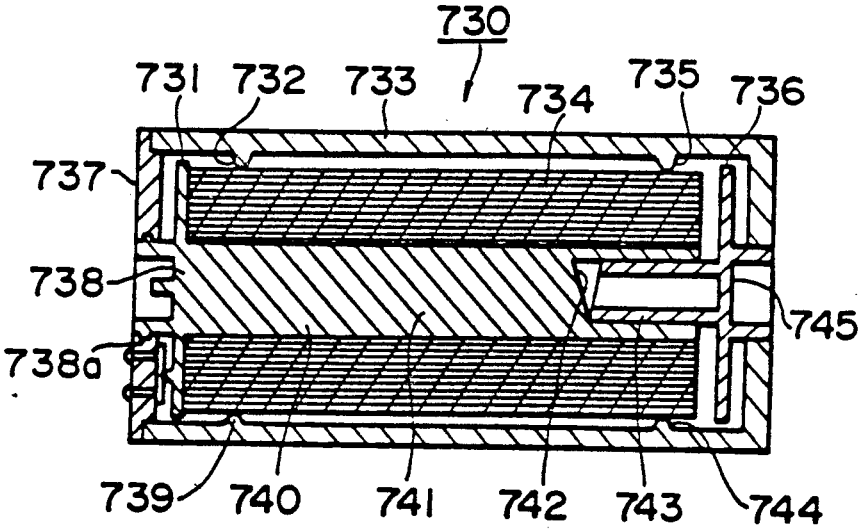
Figure 45:
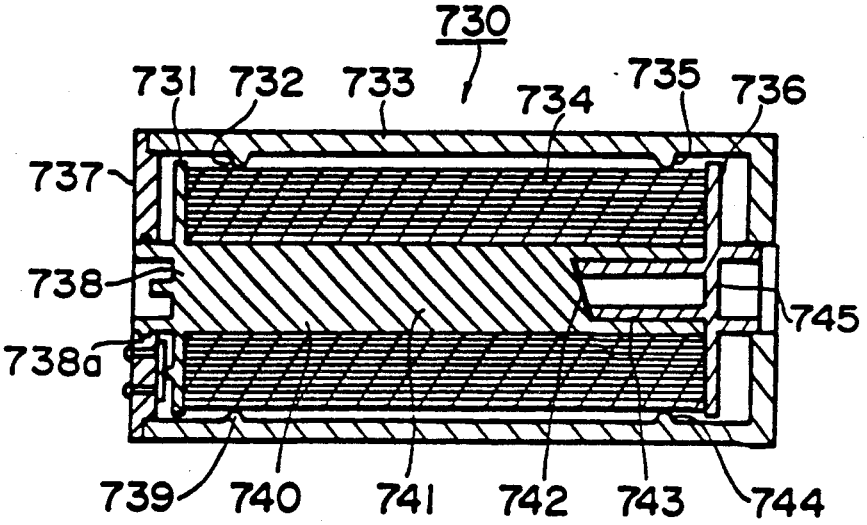

In the photographic film cartridge shown in FIG. 44 and 45, the spool 741 is composed of two spool members 738, 745 The arbor 743 of the spool member 745 is inserted in the cylindrical arbor 740 of the spool member 738 slidably. A linear rib 738*a* is formed on the arbor 740, and the rib 738*a* is fitted in the groove of the cartridge cap 737. The end of the arbor 743 is formed obliquely and the top of the oblique end is in contact with the oblique plane 742 of the arbor 740, so that the spool members 738, 745 are extended in the longitudinal direction. Flanges 731, 736 are formed on the spool members 738, 745 respectively. Ribs 732, 735 are formed in a circumferential direction on the inside surface of the cartridge body 733. The ribs 732, 735 are in contact with the outside surface of the rolled film 734, so that the deconvolution of the film 734 is prevented. When the spool member 738 is rotated, the end of the film 734 is delivered outside from the cartridge. The spool member 745 is moved to the left in this figure along a can groove (not illustrated), and the end of the arbor 743 is in contact with the oblique plane 742 of the arbor 740 as shown in FIG. 45. The spool 741 is shortened to nip both sides of the film 734. Therefore, even if the outside surface is not contacted with the ribs 732, 735 after delivering the film 734 out from the cartridge, deconvolution of the film 734 does not occur.

Figure 46:
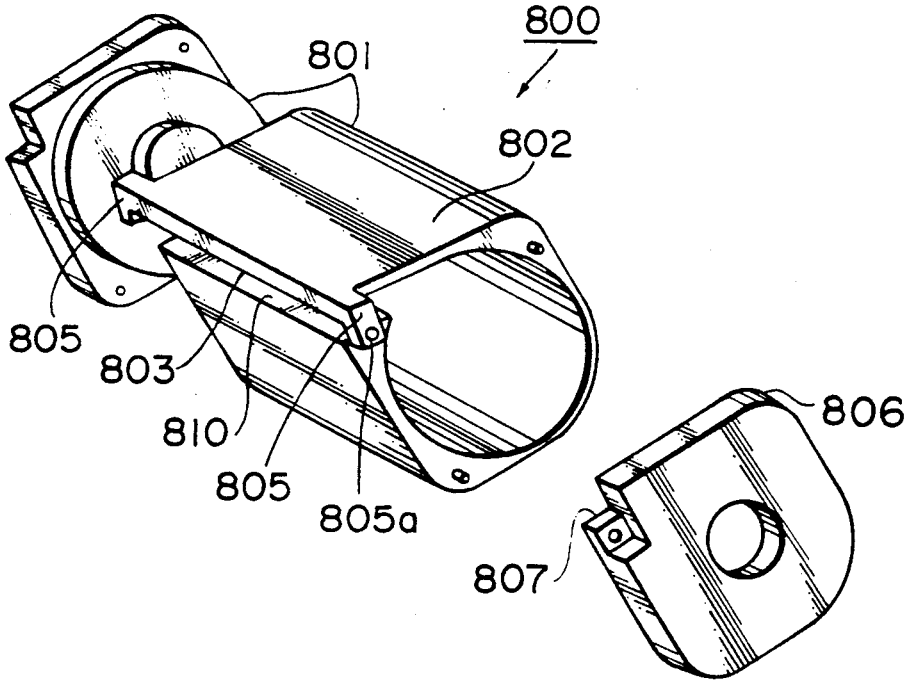
Figure 47:
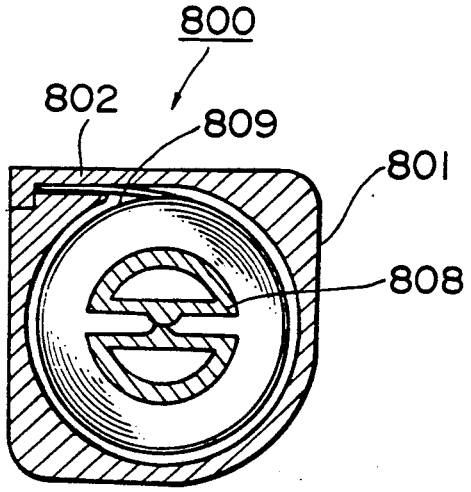

In an example shown in FIG. 46 and 47, a photographic film cartridge 800 is composed of a spool 808 on which a photographic film is rolled, a cartridge body 801 and a cap 806. The cartridge body 801 has raised portions 805 and the cap 806 is provided with cap raised portions 807, 807. The cartridge body 802 is always urged by the resiliency of the resin material composing the body toward the cap 806. Piercing holes 805*a*, 805*a* are formed in about the center of the raised portions 805, 805 of the cartridge body 802, and the cap raised portions 807, 807 are capable of being fitted in the piercing holes 805*a*, 805*a*.

In a state of not loading the cartridge in a camera (not illustrated), the cap raised portions 807, 807 are usually fitted in the piercing holes 805*a*, 805*a*, because the cartridge body 802 is urged toward the cap 806. Therefore, the photographic film 809 is kept in a lighttight state.

Besides, in a state of loading the cartridge 800 in a camera, one or both of the raised portions 805, 805 are pressed by a camera member (not illustrated). Accordingly, the raised portions 807, 807 are released from the piercing holes 805*a*, 805*a*, and the opening is formed to break the lighttightness. In this state, the photographic film 809 is extended from the cartridge 800 and treated with an image exposure, and then is wound into the cartridge again. At the time, one or both of the raised portions 805, 805 of the cartridge body 802 is pressed by the camera member, so that the cap raised portions 807, 807 are fitted in the piercing holes 805*a*, 805*a*. The opening is closed, and the photographic film 809 is kept in a lighttight state.

According to the invention, since the package is composed of using a naturally decomposable paper tube as the main material, the package can be made compact and light weight and the waste treatment is easy. Since photographic films are placed and sealed in the paper tube of which the inside is previously dried to a water content of less than 0.3%, gradual variation of the quality of the photographic films can be prevented. By providing a dress printing and shrink packaging, the package can be supplied to the commercial market without using an outer box. As a result, the number of parts can be reduced, and productive efficiency and yield are improved. Moreover, distribution cost and the amount of wastes can be reduced. When the barrier layer is provided on the inside of the paper tube, the material of the paper tube may be non-virgin pulp, and regenerated pulp which could affect photographic films adversely can be used.

We claim:

1. A package for a photographic film cartridge which comprises a paper tube treated with moistureproofing treatment, said paper tube having an inner surface that has been dried to a water content of not more than 0.3%, said paper tube containing a photographic film cartridge and having moistureproof caps wherein both end openings of the paper tube are sealed by thermal adhesion of the outside surface of the end of the paper tube and the inside surface of the moistureproof caps.

* * * * *